US012679430B2

(12) United States Patent
Galipienzo Huguet et al.

(10) Patent No.: US 12,679,430 B2
(45) Date of Patent: Jul. 14, 2026

(54) MOUNTING SYSTEM OF A PNEUMATIC MODULE AND OF AN ELECTRICAL MODULE, IN A COUPLER HEAD OF A GOODS WAGON

(71) Applicant: DELLNER COUPLERS AB, Falun (SE)

(72) Inventors: Julio Galipienzo Huguet, Beasain (ES); Mikel Oyarbide Azurmendi, Beasain (ES); Mathias Vandekerckhove, Beasain (ES)

(73) Assignee: DELLNER COUPLERS AB, Falun (SE)

( * ) Notice: Subject to any disclaimer, the term of this patent is extended or adjusted under 35 U.S.C. 154(b) by 722 days.

(21) Appl. No.: 18/009,232

(22) PCT Filed: Jun. 10, 2021

(86) PCT No.: PCT/EP2021/065631
§ 371 (c)(1),
(2) Date: Dec. 8, 2022

(87) PCT Pub. No.: WO2021/250175
PCT Pub. Date: Dec. 16, 2021

(65) Prior Publication Data

US 2023/0257006 A1 Aug. 17, 2023

(30) Foreign Application Priority Data

Jun. 11, 2020 (EP) ..... 20382505

(51) Int. Cl.
*B61G 7/10* (2006.01)
*B61G 5/08* (2006.01)
*B61G 5/10* (2006.01)

(52) U.S. Cl.
CPC ..... *B61G 7/10* (2013.01); *B61G 5/08* (2013.01); *B61G 5/10* (2013.01)

(58) Field of Classification Search
CPC ..... B61G 5/08; B61G 5/10; B61G 7/10
See application file for complete search history.

(56) References Cited

U.S. PATENT DOCUMENTS

| | | | |
|---|---|---|---|
| 1,540,936 | A | 6/1925 | Garankin |
| 1,876,918 | A | 9/1932 | Gray et al. |
| 3,556,314 | A | 1/1971 | Punwani |

FOREIGN PATENT DOCUMENTS

| | | | |
|---|---|---|---|
| CH | 425877 | A * | 12/1966 |
| CN | 1031054 | A | 2/1989 |

(Continued)

OTHER PUBLICATIONS

European Search Report in EP Application No. 20382505.4 mailed on Nov. 6, 2020, 7 pages.

(Continued)

*Primary Examiner* — Robert J McCarry, Jr.
(74) *Attorney, Agent, or Firm* — Howard IP Law Group PC

(57) ABSTRACT

A mounting system of a pneumatic module and of an electrical module, in a coupler head of a wagon or coach of a goods railway vehicle wherein both the module integrating the pneumatic connection, with the isolation or shut-off valve thereof, and the module corresponding to the electrical and data connection, are incorporated into a carriage coupled to the coupler head such that this carriage can perform a guided approach or connection movement by means of the action of an elastic means.

14 Claims, 12 Drawing Sheets

(56) References Cited

FOREIGN PATENT DOCUMENTS

| | | | |
|---|---|---|---|
| CN | 101044050 | A | 9/2007 |
| CN | 102190004 | A | 9/2011 |
| CN | 103732469 | A | 4/2014 |
| CN | 206255019 | U | 6/2017 |
| DE | 484369 | C | 10/1929 |

OTHER PUBLICATIONS

International Search Report and Written Opinion in PCT Application No. PCT/EP2021/065631 mailed on Sep. 23, 2021, 11 pages.
Chinese Office Action and Search Report in CN Patent Application No. 202180041845.3 mailed on Jul. 1, 2025; 9 pages.

* cited by examiner

MOUNTING SYSTEM OF A PNEUMATIC MODULE AND OF AN ELECTRICAL MODULE, IN A COUPLER HEAD OF A GOODS WAGON

CROSS-REFERENCE TO RELATED APPLICATIONS

This application is the national stage application under 35 U.S.C. § 371 of International Application No. PCT/EP2021/065631 filed Jun. 10, 2021, which claims priority to EP 20382505.4 filed on Jun. 11, 2020, the entire disclosures of which are incorporated herein by reference in their entireties.

FIELD OF INVENTION

The present invention is related to the railway industry and more specifically to a system that enables a module related to the pneumatic brake pipe, together with the isolation valve thereof, and a module for electrical and data connections to be mounted in a mechanical coupler of wagons or coaches of the railway sector. Moreover, this mounting system is fundamentally intended for the use thereof in a coupler based on the Willison profile, also known as SA-3 coupler, mainly used for wagons or coaches of goods railway vehicles.

BACKGROUND

Today, there are many types of wagon or coach couplers on the market. Some are mainly used in goods applications, and others in passenger applications. For the sake of simplicity in the description, henceforth the wagon or coach of a railway vehicle shall be identified only as wagon, although all that is described is equally valid for the coaches of a railway vehicle.

For years, the UIC standards have included wagon designs which allow for the integration of a semiautomatic or automatic central coupler for wagons. Some standards, such as the UIC 530-1, even define to a great degree of detail the interfaces and the type of coupler that should be used.

However, despite the great variety of solutions available, the European goods transport system does not have an automatic solution, which fulfils the same function as that which already exists and has been used for years in passenger transport.

In Europe, the most widespread solution is based in the so-called "Screw Coupler" which consists of a hitch, located on one of the two wagons, to which a chain coming from the adjacent wagon is coupled. By means of a spindle, actuated with a handle, the chain is shortened until the stops of both wagons make contact and the brake hoses, electricity, etc. are connected.

This solution forces many manual operations, both in the wagon coupling phase and in the uncoupling phase, to be carried out, which entails risk for the personnel. Moreover, the times of train production processes are significantly increased.

Furthermore, the use of these systems generates greater stress between the vehicles, causing greater wear on the track and the wheel, with the impact thereof on operational costs. This stress further generates a higher risk of derailment, because the attachment between vehicles tends to oppose the rotation of one with respect to the other, through the curved path.

In the case of passengers, most of the existing products are based on Scharfenberg-type solutions, which is the most widely used automatic coupling system in the world. One of the greatest advantages thereof is that, in addition to performing the traction and shock action, it also allows the passage of brake air without the need for hoses and connects the rest of the elements required by the train. This is possible since the Scharfenberg coupler has small tubes for the passage of brake air, as well as a keypad with electrical connectors.

However, the low load capacity of this type of coupler and the high production costs make these couplers unsuitable for use thereof in goods vehicles.

Moreover, this type of couplers used in passenger vehicles require very narrow contact between the frontal faces thereof to be able to couple, this being a problem in snow and ice environments, where the ice layers adhered to the frontal face and the mechanism may prevent the coupling thereof. It is due to this reason that these solutions use heatable elements in cold environments. This type of heatable system is not ideal for use thereof in goods trains, due to the high production and maintenance cost, as well as the increase in energy consumption.

In the field of goods transport, the most common couplers in Europe are the "Screw Coupler", those of the Janney type, which can be the D, E, F, H and "Alliance" variants thereof, all of them according to AAR (American Association of Railroads); the solutions based on the Willison profile such as the SA-3, AK69, C-AKv and Z-AK, used in countries like Russia, Iran, Turkey, China; and also other variants based on the Scharfenberg, BSI or Schwab typologies.

Although Voith's "Cargoflex" coupler, based on the Scharfenberg solution, does have a solution for incorporating electrical and pneumatic modules, there is no known solution to date that enables said modules to be incorporated into the coupler heads based on the Willison profile or similar solutions such as the "SA3" when this coupler is one of the most widely used in the world.

The very mechanical features of the "Willison" coupler have so far prevented reaching a solution that enables the electrical and pneumatic modules to be integrated, as the gaps and the relative movements between the couplers, during operation in the coupled position, damage the electrical and pneumatic connections.

In view of the described disadvantage or limitation of the existing solutions today, a solution is needed that enables the aforementioned electrical and pneumatic modules to be incorporated into a "Willison" type coupler head, namely the SA-3 variant thereof used in Russia, and this is the object of the invention.

SUMMARY

For the purpose of meeting this objective and solving the technical problems discussed up until now, in addition to providing additional advantages that are described below, the present invention provides a mounting system that enables electrical and pneumatic modules to be incorporated into a Willison-type coupler head with high safety.

According to the invention, both the module integrating the pneumatic connection, with the isolation or shut-off valve thereof, and the module corresponding to the electrical and data connection, are incorporated into a carriage coupled to the coupler head such that this carriage can perform a guided movement, paraxial to the longitudinal axis of the coupler head.

This movement can be in the direction of approach/connection by means of the action of elastic means, preferably made up of springs. The carriage is further capable of performing a withdrawal/disconnection movement, in the direction opposite to the previous one. According to a practical embodiment, the rotation of the shaft of the mechanism of the coupler head is transmitted by means of the corresponding transmission elements to a traction element which, preferably, is a cable that thus exerts a force, pulling the carriage backwards against the action of the aforementioned springs, to uncouple the modules.

The cable runs through a pulley, mounted on a support consisting preferably of a pivoting connecting rod, with elastic means that maintain the cable tension in all positions of the movement. The movements of the carriage are guided by means of a pair of guide shafts.

The carriage further has a certain play on verticality and on horizontality, according to limited, guided and damped movements by means of suspension means made up of vertical and horizontal springs; such that, with all this, the carriage has a floating elastic mount according to three Cartesian axes, one paraxial to the longitudinal axis of the coupler head and the other two according to two corresponding axes comprised in a plane transverse to the first one.

The pair of guide shafts of the carriage are arranged in a frame that is mounted on a pair of guide parts which are integral to the coupler head of the wagon, the guide parts allowing the limited movement of the frame vertically and horizontally and with it, that of the carriage, to establish the floating elastic mount of the latter.

The pneumatic module incorporates a shut-off valve that is connected to the brake pipe of the wagon and defines three chambers therein, with a tappet that a spring maintains in a closed position. The front chamber is the area of the valve nozzle, the central chamber is connected to an outlet conduit and the rear chamber, the function of which consists of performing the pressure compensation, in order to avoid making great switching stress, when working against the pressure of the air.

The valve incorporates a retention element intended to maintain the tappet in an open position, against the action of the spring. During the coupling of two wagons, the tappet of each valve is put in the open position, wherein it is retained by the retention element, connecting the front chamber with the central chamber and allowing air to pass.

The retaining element of the tappet, preferably in the form of a retaining pin, is coupled to a rocker arm which, when the carriage moves in the retraction direction, swings and removes the retaining pin, so that the tappet is released and returns to the initial position thereof, closing the passage of air, preventing the air in the pipe of the vehicle from escaping into the atmosphere.

If there is a failure in the mechanical coupling and the physical connection between wagons is interrupted in an undesired manner, the air exits to the atmosphere through the outlet conduit of the central chamber, since the tappet remains retained by the retention pin, thus lowering the pressure of air on the brake pipe.

The carriage incorporates male and female centring means, respectively, for the centring between the pneumatic and electrical connection modules of two wagons or coaches when they are coupled to each other.

The carriage further incorporates a conical or rounded pointed head, which is mounted on an axis related to a connecting rod which has a cam, associated to a ratchet mechanism. This mechanism establishes that, when the carriage moves in the direction of approach, the cam does not act on the connecting rod, while when the carriage performs a retraction movement, the cam does act on the connecting rod, causing the aforementioned head to move in the direction opposite to that of the carriage. This way, when the carriage moves in the direction of approach, the mentioned head remains immobile and without making contact; while in the retraction movement of the carriage, the head moves in the direction opposite to the valve, in order to actuate the rocker arm of the retention pin of the valve of the opposite coupler, such that by acting on the coupler of one wagon, the valves of the actuated coupler and of the opposite one shut off.

The electrical module is made up of a keypad which houses the electrical contacts and which is made up of a central body, a rear lid and a mobile cover. This mobile cover, when the carriage moves in the direction of approach, is pushed by means that lift it towards an open position; while when the carriage moves in the opposite or retraction direction, elastic means take it again to the closed position thereof.

In relation to the front portion of the carriage, a latch is arranged that retains the carriage against the action of the preloaded springs which tend to move it to the position of approach. This latch releases the carriage, when the coupling between coupler heads of two adjacent wagons or coaches takes place.

DETAILED DESCRIPTION

The present invention relates to a mounting system of a pneumatic module and of an electrical module, in a coupler head of a wagon or coach of a goods railway vehicle and more specifically in a coupler head of the type known as Willison or the SA-3 Russian variant thereof.

The railway coupler represented comprises a coupler head (1) or structure, for the mechanical centring and coupling, which includes the centring and alignment surfaces, as well as the mechanism housed therein, which by means of mobile parts, enables opposed couplers to be mechanically fixed, with the aim of transmitting traction and compression stresses between railway wagons or coaches which will be identified as wagons.

The coupler head (1) is of the semiautomatic type, because the fixing mechanism is actuated without any manual intervention or external actuation system. The mechanical fixing is based on the Willison solution, known as SA-3/CA-3 coupler of Russian origin.

The rear portion of the coupler head (1) comprises a drawbar (2), with a connection slot in the rear portion thereof according to the direction of travel of the vehicle, used for fixing to the wagon or coach, this drawbar (2) enabling the rotation of the head (1) around an axis that takes the direction of the vertical, for the correct arrangement of the vehicle on curves.

The drawbar (2) may be integrated into the part making up the coupler head (1), or it may be another independent part, joined by a semi-flange system, similar to that normally used in coupler systems of the railway sector.

Figure 1:
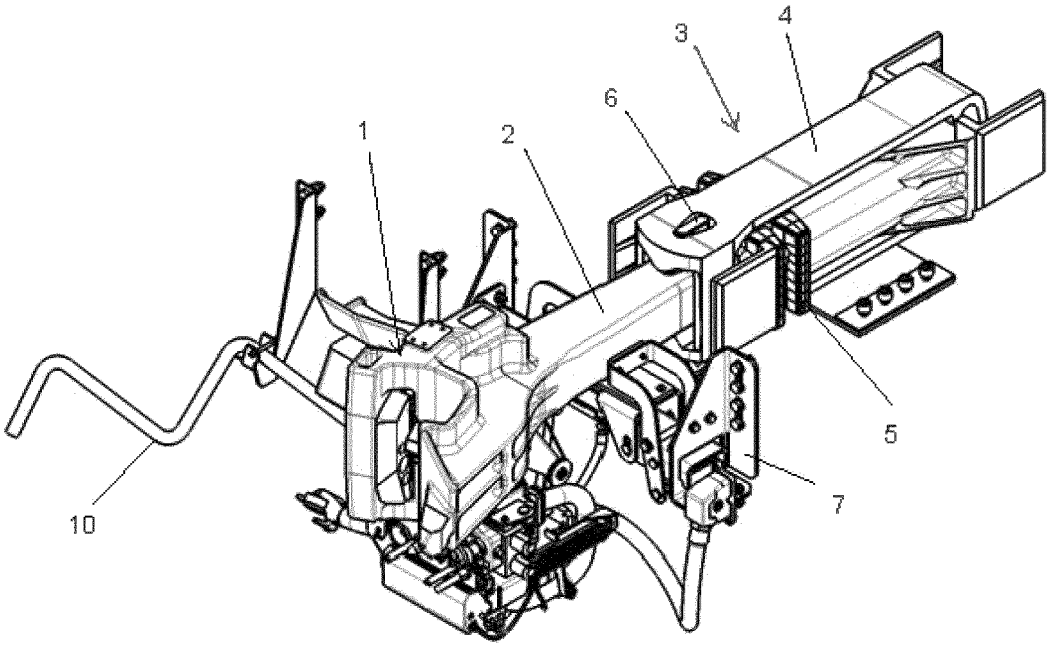
FIG. 1 is a perspective and schematic view showing the entire coupler of a wagon or coach of a goods railway vehicle.

At the rear portion of the coupler is the energy absorption system (3) which, as shown in FIG. 1, comprises the part known as the anvil (4), the damper (5) and the pin (6) for fixing the drawbar (2), and consequently the head (1), to the anvil (4).

Figure 2:
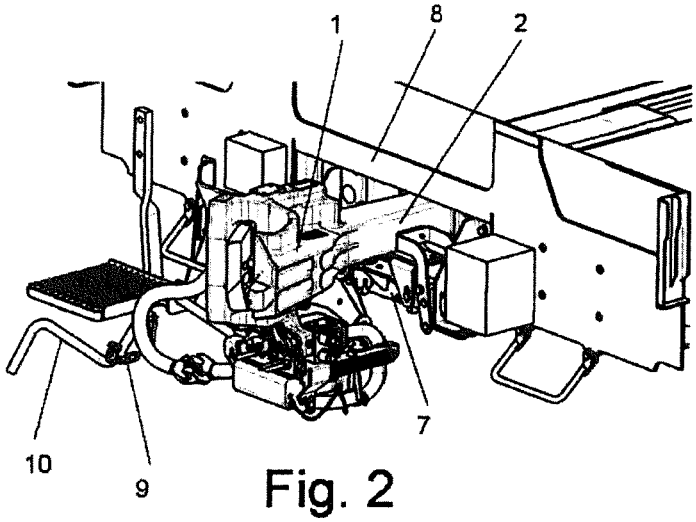
FIG. 2 is a perspective view of the coupler, together with the guide base (8) of a wagon.

As shown in FIG. 2, this energy absorption system (3) is integrated under the frame (8) of the vehicle, and transmits the traction and compression stresses by means of the stops installed on the frame. In the case of goods wagons, these stops are defined in the UIC 530-1 standard, wherein, in addition to the position and loads to be supported thereof, the dimensions of the cavity in the frame of the wagon, which houses the energy absorption system, known as the UIC tunnel, are defined.

The lower face of the drawbar (2) of the coupler head (1) rests on a structure oriented transversely to the direction of travel of the vehicle, known as vertical support and identified with the numerical reference (7) in FIGS. 1 and 2.

The vertical support (7) is fixed on the guide base of the frame (8) of the wagon, by means of screws or welding. The function of this vertical support (7) is to maintain the horizontality of the coupler head (1), as well as to perform the centring of the same, when the vehicle is travelling in the uncoupled position, on curves.

The mechanical fixing system, of the Willison or SA-3/CA-3 type, is of the so-called semi-automatic type, because the coupling between wagons is carried out automatically, but the uncoupling requires an external actuation system to carry out the mechanical uncoupling. This external manual actuation system can use an uncoupling lever (10), installed on the guide base of the vehicle, in a direction transverse to the direction of travel of the vehicle, which incorporates a chain (9) or connecting cable at the closest end thereof to the central point of the track. This chain (9) or cable is attached at the opposed end thereof to a connecting rod (11), see FIG. 3, integrally attached to the shaft of the fixing mechanism, housed inside the head (1). The operation can further be performed by means of an electrical or pneumatic actuator, installed on board, which tensions the chain which is dragged by the lever, or which tensions a second chain, which also starts from the same fixing point or connecting rod (11) linked to the shaft of the mechanism. There are other possibilities of external actuation, by means of an actuator or robot installed outside the vehicle, which actuates on the mechanism.

This whole set of mechanisms, by means of which the coupling or uncoupling between two adjacent wagons is carried out, is arranged in the central area of the two ends of the wagon, not being able to speak of front or rear ends because the wagons can move in both directions. Likewise, it must be taken into consideration that the coupler can be rotated and not coincide with the direction of movement of the vehicle. In fact, the forward direction of the vehicle only coincides with that of the coupling on the straight tracks, not on the curve ones, but, for simplicity of description, throughout this description and throughout the whole invention when the direction of movement of the wagon or of the vehicle as a whole is mentioned, it should be assumed that this direction coincides with that of the coupler and, therefore, with that of the associated elements thereof.

Figure 3:
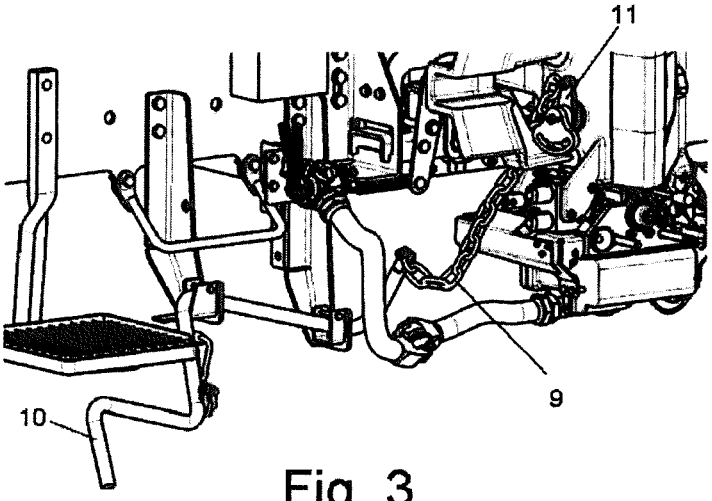
FIG. 3 is a perspective view showing the chain (9) connecting the actuation lever (10) to the rotation cam (11) of the fixing mechanism of the coupler head (1).

Everything mentioned thus far can be considered to be part of the state of the art. As shown in FIGS. 1, 2 and 3, in the lower portion of the head (1) the modules integrating the pneumatic connection of the brake pipe are incorporated, together with the isolation or shut-off valve, as well as the electrical connection, responsible for transmitting data and/or power signals. For this, the lower portion of the head (1) has fixing surfaces, which enable these modules to be linked and it is precisely in how the mounting of these modules is performed and in the special constitution of some of the components thereof wherein the essence of the present invention lies.

Figure 4:
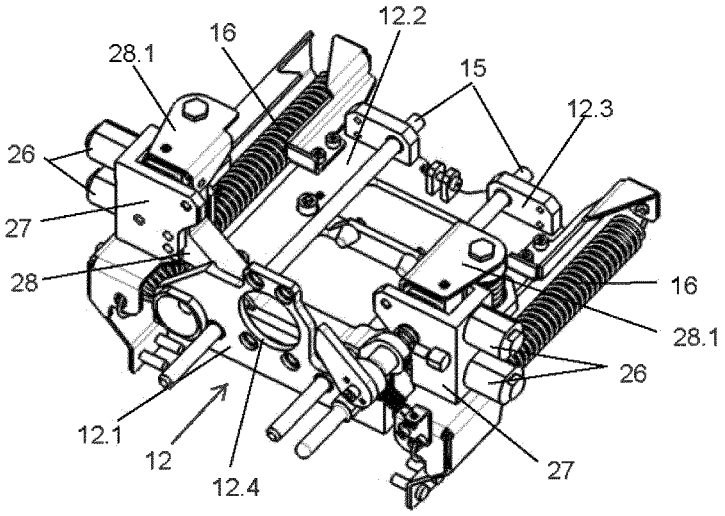
FIG. 4 shows in frontal perspective view and according to a non-limiting practical exemplary embodiment, the mobile carriage (12) with the guides (15) thereof, not having represented the pneumatic and electrical modules, in order to better see the mechanical structure of the carriage (12).
Figure 5:
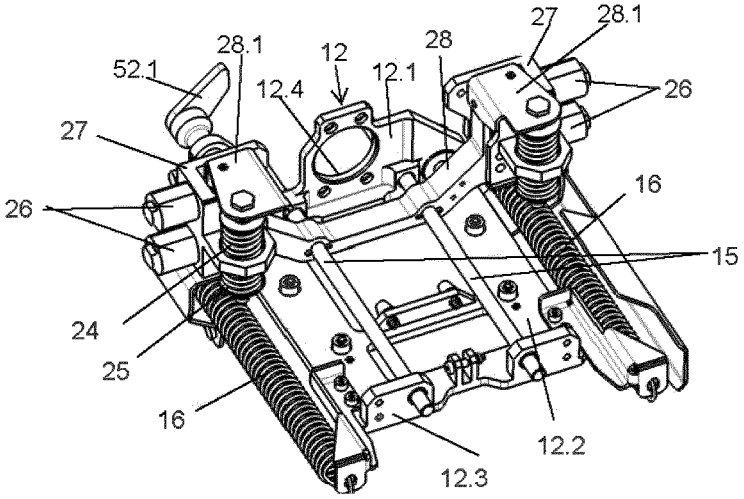
FIG. 5 shows a view like the preceding one, but now from the rear portion of the carriage (12).

According to the invention, said modules for the pneumatic, electrical and data connection between wagons are arranged in a carriage (12), see FIGS. 4 and 5. This carriage is a mobile structure, which integrates the shut-off valve or pneumatic isolation valve (13), as well as the electrical connectors box or keypad (14). These elements are arranged in centred position, with respect to the central point of the track, or central lateral plane of the vehicle and of the coupler, and with the shut-off valve (13) arranged in the top portion and the keypad (14) in the lower one, or vice versa.

The carriage (12), as shown in FIGS. 4 and 5, is made up of a U framework, with a front portion (12.1), a base (12.2) and a rear portion (12.3). In the front portion (12.1), there is an orifice (12.4) for the mounting of the valve (13).

The function of this carriage (12) is to approach or move away the front contact surfaces of the pneumatic and electrical connection modules when the two coupler mechanisms of two adjacent wagons are facing each other. This is performed when the heads (1) are already coupled, by means of a movement of the carriage (12) in the direction of the path of the vehicle and in one direction or the other depending on whether the wagon is at the front or at the rear.

This movement is going to be identified as approaching movement which allows the corresponding surfaces of both carriages (12) to make contact, in order to carry out the electrical, the data and the pneumatic connection. Furthermore, this movement is also responsible for interrupting these connections, by means of a movement of the carriage (12) in a direction opposite to the direction of approach which will be identified as retraction movement. These movements, in addition to enabling or interrupting these connections, have the function of protecting the contact surfaces of these connection elements from the transversal movements that take place between the coupler heads (1) during the coupling and uncoupling process.

The approaching and retraction movement of each carriage (12) is guided by means of a pair of guide shafts (15), the theoretical longitudinal axes of which are paraxial to the theoretical longitudinal axis of the coupler head. The approaching movement of the carriage (12) is driven by means of a device using springs (16) or by any other analogue conventional solution.

Figure 9:
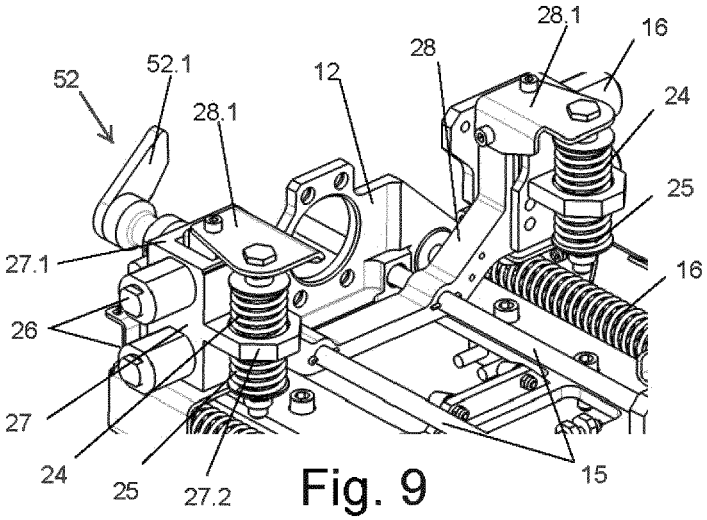
FIG. 9 is a detailed perspective view, in order to see the vertical and horizontal mounting system of the carriage (12).

As shown in FIGS. 5 and 9, the pair of guide shafts (15) cross a part identified with the numerical reference (28) which makes up the frame of the guide shafts (15) of the carriage (12).

The retraction movement of the carriage (12) is performed by means of a cable, chain or similar. According to a non-limiting practical exemplary embodiment, represented in FIGS. 6 and 7, and in the detail of FIG. 8, a cable (17) is used which on one end, see FIG. 8, is coupled to the rear portion of the carriage (12), but it can further be coupled to another point of the carriage (12).

The other end of the cable (17) is connected to a connecting rod (18) integral to the rotation shaft of the mechanism of the coupler head (1); such that when the uncoupling lever (10) is acted upon and a rotation is generated in the shaft of the mechanism of the head (1), the uncoupling of the fixing element of the coupler is carried out and, at the same time, the cable (17) is tensioned, generating the retraction movement of the carriage (12), and removing the pneumatic and electrical connection elements, thus interrupting the pneumatic and electrical connection between vehicles.

The cable (17) has guide elements, which can be made up of pulleys (19 and 22) or equivalent elements, which fulfil the function of guides, but they also maintain the tension thereof during the whole coupling operation sequence.

Figure 6:
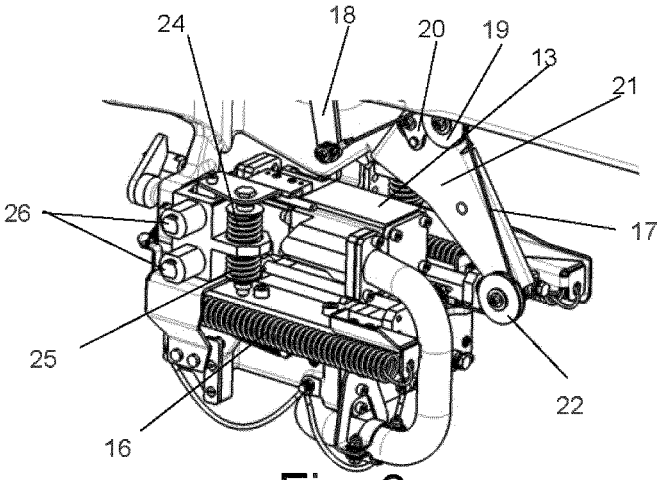
FIG. 6 is a perspective view from the rear portion of the carriage (12), in order to see a side of the carriage (12).
Figure 7:
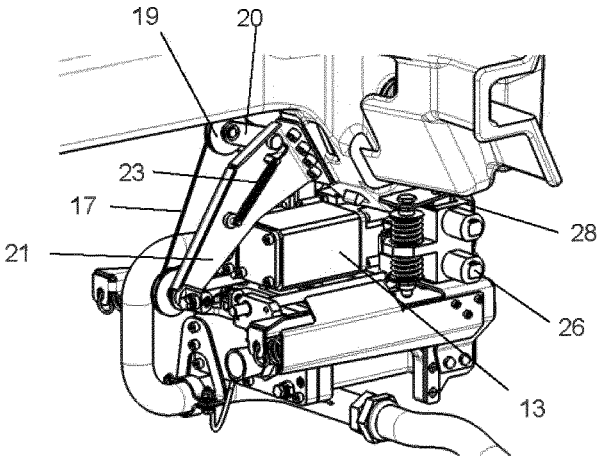
FIG. 7 shows a view like the preceding one, but now from the other side.
Figure 8:
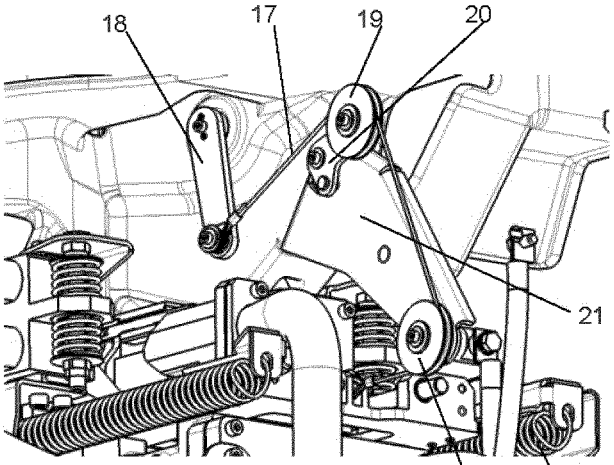
FIG. 8 is a detailed enlargement and perspective view of FIG. 6, in order to see the mounting of the retraction cable (17) of the carriage (12).

According to a non-limiting practical exemplary embodiment, represented in FIGS. 6, 7 and 8, the pulley (22) is mounted on a fixed shaft; while the shaft of the pulley (19) is mounted on a mobile connecting rod (20), arranged in a bracket (21), wherein a spring (23) is mounted which provides the mobile connection rod (20) with a floating arrangement, tensioned by the spring (23). In this way, both in the approaching movement and in the retraction movement of the carriage (12), the cable (17) is always kept properly tensioned.

It has been envisaged that this tensioning of the cable (17) can be carried out by means of other configurations such as, for example, a system that drives the pulley (19) linearly with elastic means that provide it with that floating mount.

As a variant of practical embodiment, alternatives are further envisaged that use these devices in an inverse manner, that is, a cable (17), chain or similar that drives the carriage towards the approaching position thereof and devices which use springs (16), either by compression or traction or even other equivalent means that drive the carriage (12) towards the retraction position thereof.

In order to protect the electrical, data and pneumatic connection systems from the relative movements between the coupler heads (1), the carriage (12), in addition to the forward and retraction movement, has a mounting system that provides it with certain floating elastic play, with a limited capacity of vertical and horizontal movement, according to two orthogonal axes, contained in a plane transverse to the theoretical longitudinal axis of the coupler head. One of the axes is oriented according to the vertical direction and the other according to the horizontal one.

This mounting system is arranged between the carriage (12) and the fixed portion wherein the carriage (12) is mounted, fixed portion that is connected to the structure of the coupler head (1).

According to a non-limiting practical embodiment, this mounting system of the carriage (12) is determined by means of springs, but it will be also possible to carry it out by means of other solutions, such as for example, silent-block elastic elements or other conventional means which provide a mounting of the carriage (12) with the possibility of certain floating elastic play.

The arrangement of the vertical mounting system may comprise two, four or more springs. According to a preferred practical embodiment, as shown in FIGS. 5 and 9, two pairs of springs (24 and 25) are arranged in relation to each side of the carriage (12). According to this embodiment, a preload of each pair of springs (24 and 25) is established; such that they both work by compression, under the same load, in the nominal mounting position. In this way, when there is a vertical movement, one is loaded and the other is unloaded. The aim is to maintain a characteristic curve, as symmetrical as possible, in both directions of movement.

The horizontal mounting system admits the same variants of embodiment as the vertical one and the aim thereof is to perform a push or traction stress on specific surfaces of the carriage (12). According to a preferred embodiment, it comprises a pair of cartridges (26) on each side of the carriage (12), as shown in FIGS. 5 and 9.

Figure 10:
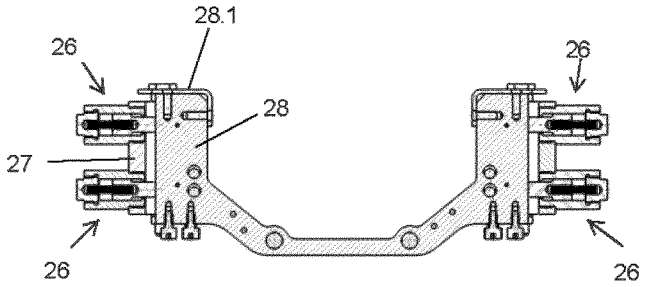
FIG. 10 is a sectional view of the frame (28) of the guide shafts (15), wherein the mounting of the cartridges (6) for the horizontal mounting of the carriage (12) can be seen.
Figure 10A:
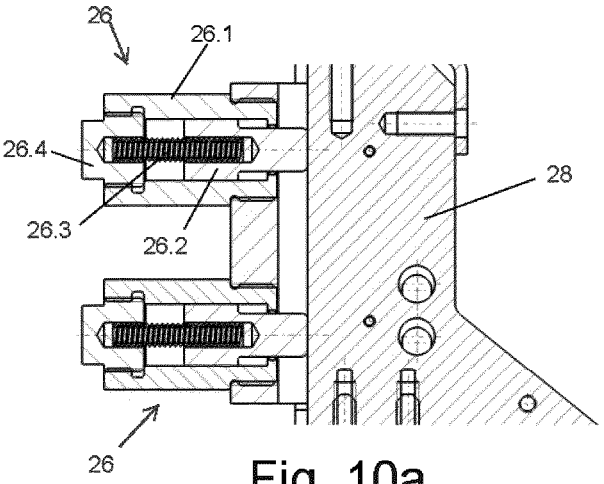
FIG. 10*a* is a detailed enlargement view of one of the ends of FIG. 10.

FIG. 10*a* shows how each cartridge (26) is made up of a body (26.1), wherein a spring (26.3) is mounted, which is arranged between a rear lid (26.4) and a push piston (26.2).

As shown in FIGS. 4, 5 and 9, there are guide parts identified with the numerical reference (27) which are fixed to the lower portion of the coupler head (1). The morphology of these guide parts (27) which is shown in FIG. 11 is defined by a body (27.1) of a "C" upper plan and a cantilevered projection (27.2) in the central area thereof, wherein the respective ends of the springs (24 and 25) fit in.

The shaft of the springs (24 and 25) is fixed on the upper portion thereof to a plate (28.1) integral to the support frame (28) of the guide shafts (15) of the carriage (12) and on the lower portion it is also similarly fixed to the support frame (28).

Figure 12:
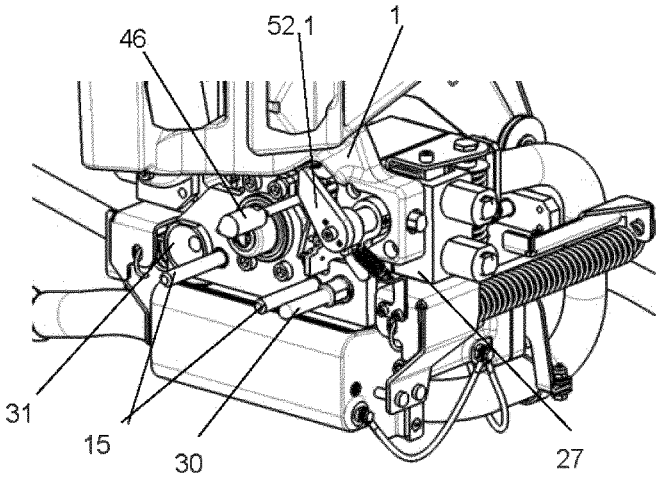
FIG. 12 is a perspective view showing the carriage (12) from the front.

The support frame (28) is, on the ends thereof, guided in vertical and horizontal direction in the guide parts (27) integral to the coupler head (1), see FIG. 12; all of this enables a mounting of the carriage (12) with possibility of movement along the guide shafts (15) supported by the frame (28) and also a floating and damped movement, with a limited path, of the carriage (12) in vertical and horizontal direction, along axes contained in a plane transverse to the direction of movement of the wagon.

Figure 11:
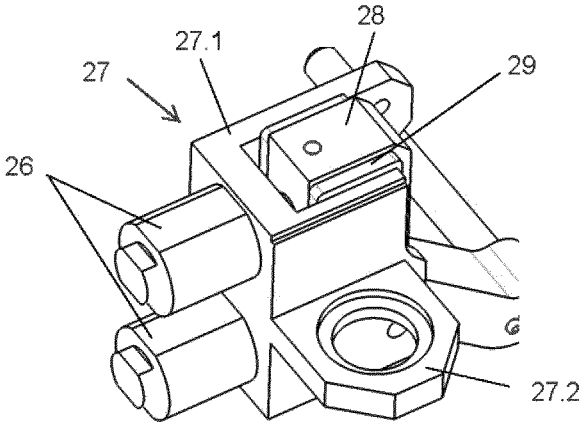
FIG. 11 is a detailed perspective view, in order to see the configuration of the guide parts (27).

As shown in FIG. 11, rebar spacers (29) of low friction plastic or metal material are arranged between the support frame (28) and the guide parts (27), for improving the sliding therebetween. To the same end, it has been envisaged that the tip of the head of the piston (26.2) of the cartridges (26) is made of low friction plastic or metal material.

This vertical and horizontal mounting system of the carriage (12) maintains it in the centred position thereof, with respect to the vertical and transversal movements that this mounting system allows. In this way, when the coupler head (1) is in uncoupled position, the mounting system takes the carriage (12) to the central position thereof, in horizontal direction and also in vertical direction, having certain capacity for elastic movement in both directions, in each direction of the allowed movement. This limited capacity of elastic movement translates into a floating mount which is key to being able to incorporate a pneumatic and electrical connections module to a Willison type coupler head or the SA-3 Russian variant thereof.

Actually, the large mechanical gaps existing between the coupler heads (1) of the goods wagons, when they are in the coupled position, allow high relative movements between the coupler heads (1). In order to maintain the connections between the pneumatic and electrical modules of both couplers, it is necessary to have a system such as that of the present invention, which allows certain floating elastic play to the connection modules and disconnects them from the relative movements between the heads (1).

In order to make the surfaces of the pneumatic and electrical connection elements coincide, between two couplers facing each other, the carriage (12) has centring means, made up of a male element (30), based on a cylindrical geometry, with the free end thereof finishing with a semi-spherical or conical shape, and a female element (31), with a conical receiving geometry, followed by a cylindrical bore, see FIG. 12.

Figure 15:
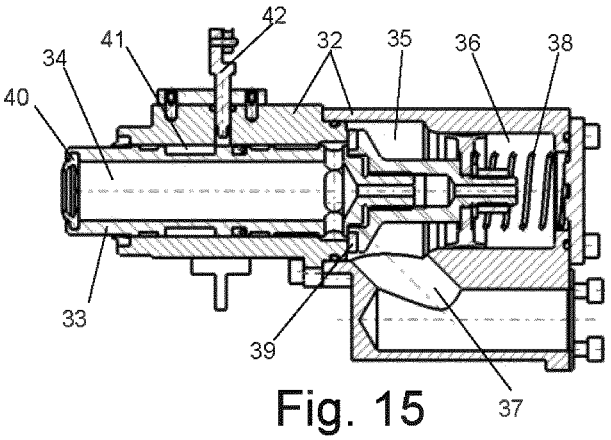
FIG. 15 is a longitudinal section detailed view of the valve (13), in order to see the inner portion thereof.

As part of the pneumatic connection module, there is a shut-off or isolation valve (13) formed by a surrounding body that can be made of one single part or several parts and that will be identified as casing (32), inside of which a sliding part is housed, as a tappet (33) which has the function of slider to perform the sealing and closing, or allowing the passage of air, as necessary in each case, see FIG. 15.

The valve (13) has three chambers therein, a front one (34), in the area of the nozzle (40), another central one (35), which is connected to an outlet conduit (37) and a rear one (36), the function of which consists of performing the pressure compensation, in order to avoid making great switching stress, when working against the pressure of the air. For this, the tappet (33) has a central conduit of communication, between the front chamber (34) and the rear one (36).

A compression spring (38), installed in the rear portion, pushes the tappet (33) to the forwardmost position thereof, which is the rest position and prior to the coupling process. This pressure exerted by the spring (38) is further used to secure the sealing between the nozzles (40) of the valves (13), for which these nozzles (40) further incorporate an elastomer element at the end thereof.

When the valve (13) is actuated by applying external force on the front nozzle (40), the tappet (33) moves towards the rear portion, against the action of the respective spring (38) thereof, communicating the front chamber (34) with the central chamber (35) by means of the loss of contact of a central gasket (39) with the closing surface thereof. In this position, the air passes from the front chamber (34) to the central chamber (35) and from this chamber to the outlet conduit (37).

At the same time, during the process of moving the tappet (33), interlocking is performed, by means of a locking system of the valve (13), which prevents the tappet (33) from returning to the original position thereof. This blocking system is made up of a retention element (42), preferably in the shape of a retention pin, which, by means of a preload system, fits on a recessed surface (41) in the contour of the tappet (33).

This locking system is necessary, for the possible case of a failure occurring in the mechanical coupling and the physical connection being interrupted between, for example, two wagons of the vehicle. In this case, the function of the valve (13) is to communicate the Automatic Brake Pipe (ABP) of the wagon to the atmosphere. Therefore, in this case, the front chamber (34), the outlet of which connects to the vehicle, remains in a communicated position with the central chamber (35), expelling air stream to the atmosphere through the outlet conduit (37) and lowering the air pressure on the brake pipe.

However, when an intentional uncoupling operation is sought to be performed, this communication must not exist, and the valve (13) must close the passage of air from the central chamber (35) to the front chamber (34) by means of closing the central gasket (39).

Figure 16:
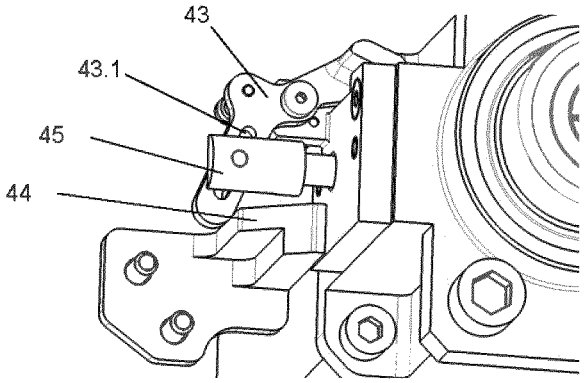
FIG. 16 is a perspective detailed view showing the actuation mechanism of the retention element (42), which is intended to block the tappet (33) of the valve (13).

In order to return the tappet (33) to the original position thereof, there is a mechanism, made up of a rocker arm (43) with an oblong slot (43.1), wherein a single-piece rod (45) is housed that on the closest end thereof to the valve (13) is related to the retention element (42). The rocker arm (43) is related in turn to an inclined ramp (44) which is fixed with respect to the valve (13), see FIGS. 13, 14 and 16.

When the carriage (12) moves the valve (13) in the retraction direction, the inclined ramp (44) makes contact with the end of the rocker arm (43), which translates into the movement of the latter and with it, the movement of the part (45) that removes the retention element (42) from the housing thereof in the recessed surface (41) of the contour of the tappet (33), position that corresponds to that represented in FIG. 15; such that the tappet (33) is returned to the original position thereof, closing the passage of air.

Figure 13:
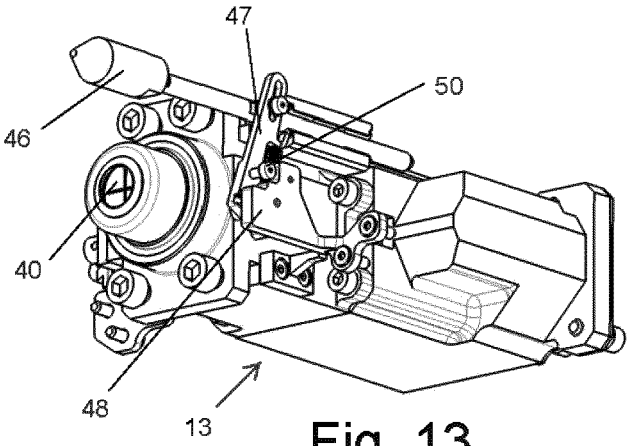
FIG. 13 is a perspective view schematically showing the pneumatic isolation valve (13), from one side and according to a non-limiting practical exemplary embodiment.
Figure 14:
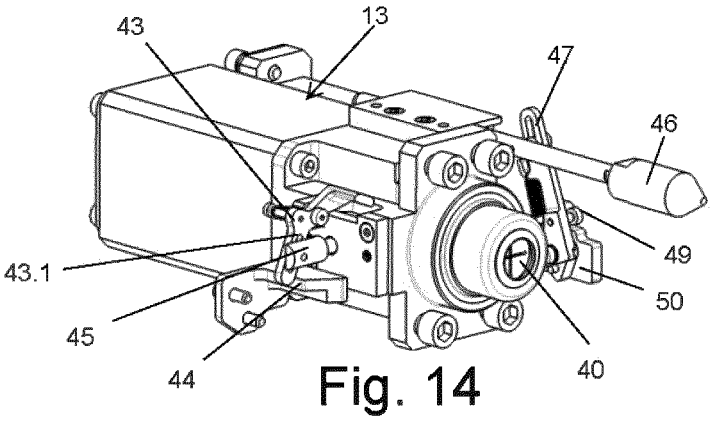
FIG. 14 shows a view like the preceding one, but from another side of the valve (13).

At the same time that this movement of the carriage (12) is performed in the retraction direction, a shaft with a conical head (46), installed in the casing (32) of the valve (13), see FIGS. 13 and 14, moves in the direction opposite to the valve (13). The function of this head (46) is to actuate the rocker arm (43) of the valve (13) of the opposite coupler, such that by acting on a coupler, the valves (13) of the actuated coupler and the opposite one shut off. Otherwise, the valve (13) installed on the opposite coupler would not perform the closing movement and the opposite wagon would apply an undesired braking condition.

Figure 17:
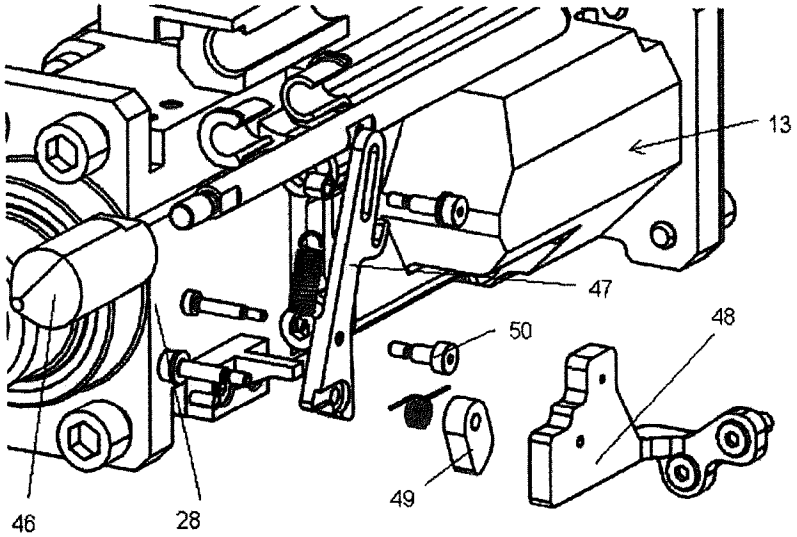
FIG. 17 is an exploded perspective view to be able to see the mechanism which establishes that at the same time that the movement of the carriage (12) takes place in the retraction direction, the rocker arm (43) of the valve (13) of the opposite coupler is actuated, such that by acting on a coupler, the valves (13) of the actuated coupler and of the opposite one shut off.
Figure 18:
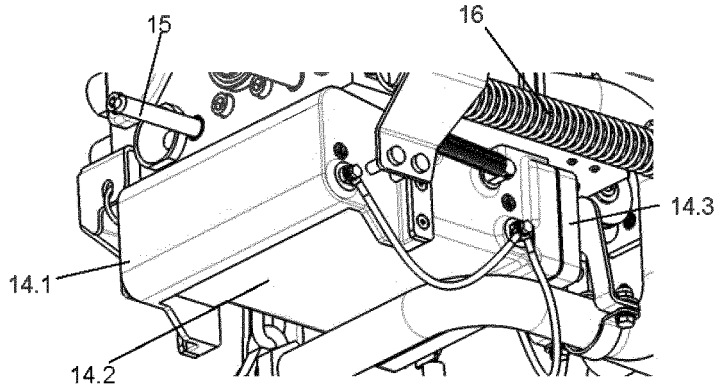
FIGS. 18 and 19 are perspective detailed views of the frontal and side portions, respectively, of the electrical keypad (14).

To ensure this, as shown in FIGS. 13 and 17, a connecting rod (47) is arranged which, by means of an oblong slot, connects to the head of the conical head (46). This connecting rod (47) has a rotation shaft (50) connected to the support frame (28) of the guide shafts (15). A cam (49) is arranged on the lower end of the connecting rod (47), as shown in FIG. 18. In this way, when the valve (13) moves in the retraction direction of the carriage (12), an actuator (48) makes impact against the cam (49), and this latter one transmits the rotation to the connecting rod (47), which causes the shaft with the conical head (46) to come out towards the front portion. When the shaft with the conical head (46) comes out forwards, it impacts against the rocker arm (43) of the valve (13) of the opposite coupler, removing the interlocking of the retention element (42) and allowing the valve (13) to return to the closed position thereof.

When the carriage (12) makes an approaching movement, the actuator (48) impacts against the rear face of the cam (49), connected to the connecting rod (47), such that the cam (49) pivots without dragging the connecting rod, with a ratchet mechanism, which only transmits torque in one direction of rotation, leaving the other free.

As a variant practical embodiment, to achieve the rotation of the connecting rod (47) and the consequent forward movement of the shaft with the conical head (46), it is possible to take advantage of the action of the cable (17), used for the retraction, of the carriage (12); such that the cable (17) would be linked to the connecting rod (47), at the opposite end thereof to the lower pivot point, so that the same movement is performed.

The connecting rod (47) must not perform any movement during the approaching movement of the carriage (12). For this, in the solution based on the use of the cam (49), and as it has been explained, the cam (49) can rotate, without dragging the connecting rod (47) in a ratchet type mechanism. In the embodiment variant that uses the force of the tensor cable (17), during the approaching movement of the carriage (12), the cable (17) just by itself does not exert sufficient tension so as to make the connecting rod (47) rotate.

The keypad (14) houses the signal and power electrical contacts and, if applicable the data contacts, and is fixed to the lower face of the mobile carriage (12), but in another configuration, it could be done on the upper face of the same. The keypad (14) is made up of the central body (14.2), the rear lid (14.3) and the mobile cover (14.1), which serves as sealing and protection against impacts and against electrical shocks, when the keypad (14) is at rest, prior to the coupling process, see FIGS. 18, 19 and 20.

The central body (14.2) fulfils the function of housing the contacts and the cables; the rear lid (14.3) serves as a rear closure and houses the connectors from where the electrical hoses start and the mobile cover (14.1) serves as a lid or closure and sealing element of the electrical contacts.

In another variant of practical embodiment, the main body (14.2) of the keypad (14) can be determined by the very framework of the carriage (12), the mobile carriage (12) including all the elements that make it up.

The nature of the electrical signals that the keypad (14) includes may be digital, analogue or electrical power, to supply systems on board the vehicle. The electrical connection may be performed by means of physical electrical contacts, such as those currently used, optical communication, or by means of a contactless system, of the so-called NFC (Near Field Contacts).

When the coupling is performed, the carriage (12) moves in the direction of approach to the keypad (14) of the adjacent wagon, moving the keypad (14) along with it. During this movement, called approaching movement, one or two surfaces in the sides of the mobile cover (14.1) make contact with one or two pins, or surfaces, which generate a rotation of the same along a horizontal axis, transverse to the direction of movement of the vehicle. This rotation can be clockwise or anti-clockwise, depending on the arrangement of the elements on the mobile carriage (12). The rotation uncovers the frontal face of the keypad (14), wherein the power and signal connectors are housed.

Figure 19:
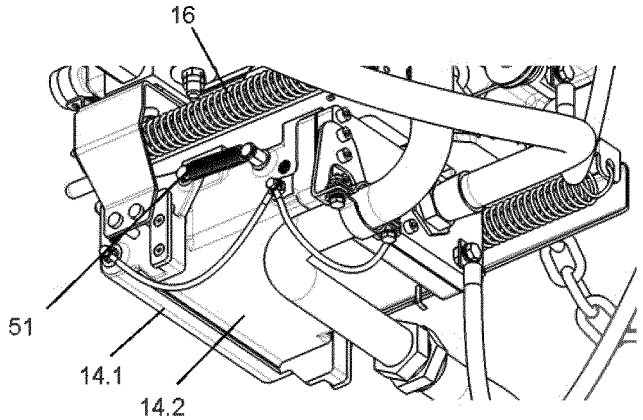
Figure 20:
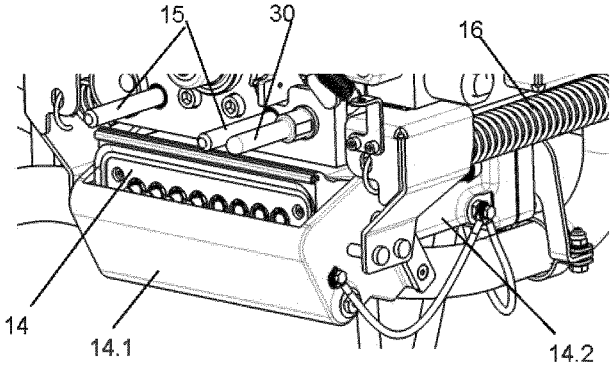
FIG. 20 shows the keypad (14) with the lid (14.1) thereof partially open.

In the same way, when the inverse movement of the mobile carriage (12) takes place, in the so-called retraction movement, the keypad (14) moves backwards, and with it, the mobile cover (14) returns to the initial position thereof, by the action of springs (51), arranged on the sides thereof, which ensure this return to the initial position, see FIG. 19.

As the mobile carriage (12) moves by means of two or more springs (16), which in the state prior to the coupling, are preloaded, it is necessary to arrange a system that maintains the mobile carriage (12) retained in the initial position thereof, ensuring that this position is stable, until the mobile carriage (12) must move by the action of the springs (16) in the so-called approaching movement.

Figure 21:
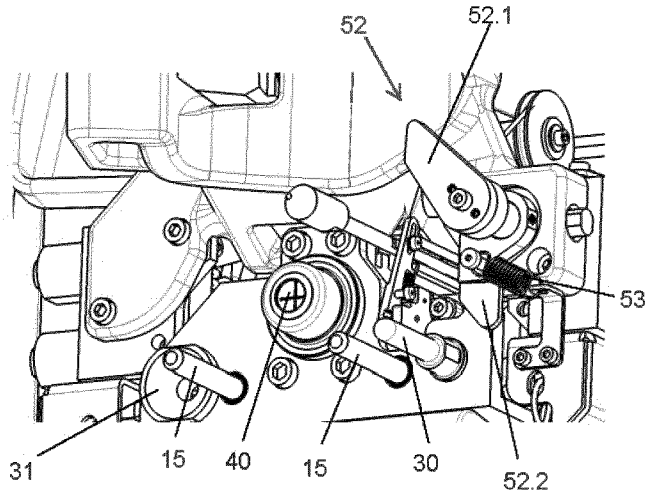
FIG. 21 is a perspective detailed view to be able to see the latch mechanism (52) which has to automatically release the carriage (12), so that this carriage can move in the direction of approach by the action of the springs (16).

The retention element of the mobile carriage (12) is a latch (52), and the function thereof is to retain the mobile carriage (12), as well as release it, when the coupling between coupler heads (1) takes place. For this, as shown in FIG. 21, the latch (52) is made up of two arms (52.1 and 52.2) which may also be two defined surfaces in one same part.

If two wagons that are going to couple with each other are identified as wagons "A" and "B", the arm (52.1) of the wagon "A" is intended to make contact against the minor tooth of the opposing coupler head (1) belonging to the adjacent wagon "B", with which the coupling is going to take place, and the arm (52.2) of the wagon "A" is making contact with the frontal face (12.1) of the mobile carriage (12) thereof, retaining it. When the minor tooth of the opposing coupler head (1), belonging to the wagon "B", abuts against the housing of the coupler head (1) of the wagon "A", this minor tooth makes contact with the arm (52.1) of the latch (52) of the wagon "A". At this moment, the latch (52) of the wagon "A" performs a limited rotation in the clockwise direction, seen from the frontal face to the guide base of the vehicle, forcing the second arm (52.2) thereof which is retaining the carriage (12) to rotate, losing contact with the frontal face (12.1) of the carriage (12); such that this is released to carry out the approaching movement.

One or several springs (53) ensure the return thereof to the original position. Another possible variant of practical embodiment may be based on using the off-centred weight of the latch (52) to ensure the torque which allows it to return to the original position thereof.

In exceptional cases, in which it is necessary to perform a retraction movement of the carriage (12), with the coupler head (1) of a wagon not making contact with the coupler head (1) of another wagon, a solution is necessary to force the latch (52) to perform a limited rotation movement in the anti-clockwise direction, followed by a clockwise one, which allows it to position again in the frontal face of the carriage (12), the original position thereof. For this, it has been envisaged that in the rear side of the frontal plate (12.1) of the mobile carriage (12), an inclined surface or analogue solution can exist, which forces the latch (52) to perform this rotation.

The invention claimed is:

1. A mounting system of a pneumatic module and of an electrical module, in a coupler head of a goods wagon, the mounting system comprising:

a carriage which incorporates the electrical module, the pneumatic module and a shut off valve;

wherein the carriage is structurally arranged to allow guided elastic movement in a direction paraxial to that of a longitudinal axis of the coupler head and is further structurally arranged to allow a limited, guided and elastic movement path, in the direction of a vertical axis and of a horizontal axis, said vertical and horizontal axes being comprised in a plane transverse to the longitudinal axis of the coupler head, to establish a floating elastic mount of the carriage in three axes perpendicular to each other, which allows the relative movement between the pneumatic and electrical connection modules, with respect to the coupler head.

2. The mounting system of claim 1, wherein the carriage further comprises springs which establish a pushing force in the direction paraxial to that of the longitudinal axis of the coupler head, to take the carriage to an approaching position with respect to a carriage of an adjacent wagon, in the coupling of both wagons.

3. The mounting system of claim 2, wherein in relation to a front portion of the carriage, a latch is arranged that retains the mobile carriage against the action of preloaded springs; and wherein the latch releases the carriage, the coupling between the coupler heads of the two wagons takes place.

4. The mounting system of claim 1, further comprising a tensor element which on one end is integrated with the rotation shaft of the mechanism of the coupler head, and on the opposite end is coupled to the carriage; and wherein, when the uncoupling between two wagons is established, the tensor element, pulls the carriage moving it in the retraction direction, opposite to the direction of approach, to disconnect the connections of the pneumatic and electrical modules.

5. The mounting system of claim 4, wherein the tensor element runs through a pulley, mounted on a support comprising a pivoting connecting rod, with elastic means that maintain the tension of the tensor element in all positions of the movement.

6. The mounting system of claim 4, wherein the tensor element comprises a cable or chain.

7. The mounting system of claim 1, wherein the shut-off valve is connected to a brake pipe of the wagon and defines three chambers therein, with a tappet that a spring maintains in a closed position; and wherein the shut-off valve incorporates a retention element which maintains the tappet in an open position, against the action of the spring, such that in the coupling between two wagons, the tappet of each valve is put in the open position, wherein it is retained by the retention element, thereby allowing air to pass.

8. The mounting system of claim 7, wherein the retaining element of the tappet is coupled to a rocker arm which, when the carriage moves in the retraction direction, swings and removes the retaining element, so that the tappet is released and returns to the initial position thereof, closing the passage of air, thereby preventing the air in the pipe of the vehicle from escaping into the atmosphere.

9. The mounting system of claim 8, wherein the central chamber of the valve is connected to an outlet conduit, wherein, on the condition of a failure in the mechanical coupling and the physical connection between wagons is interrupted, the retention element maintains the tappet in an open position, against the action of the spring, such that the air exits to the atmosphere through the outlet conduit.

10. The mounting system of claim 8, wherein:

the carriage incorporates a head mounted on an axis related to a connecting rod having a cam associated to a ratchet mechanism;

wherein the ratchet mechanism establishes that, when the carriage moves in the direction of approach, the cam does not act on the connecting rod;

wherein when the carriage performs the retraction movement, the cam actuates on the connecting rod, thereby causing the head to move in the direction opposite to that of the carriage;

wherein when in the approaching movement, the head impacts against the rocker arm of the retention element of the valve of the opposite coupler, removing the interlocking of the retention element and allowing the valve to return to the closed position thereof; and wherein when in the retraction movement, the head moves in the direction opposite to the valve, to actuate the rocker arm of the valve of the opposite coupler, such that, by actuating on the coupler of a wagon, the valves of the actuated coupler and the opposite coupler shut off.

11. The mounting system of claim 1, wherein the carriage is mounted on guide shafts of a guide frame, and wherein the guide frame is mounted on a pair of guide parts integral to the coupler head between wagons;

wherein the guide parts allow limited movement of the frame vertically and horizontally and with it, limited movement of the carriage.

12. The mounting system of claim 11, wherein each guide part comprises first elastic means arranged according to a vertical axis, and second elastic means arranged according to a horizontal axis which maintains the carriage in a stable position centred in both vertical and horizontal directions and allowing the elastic floating play thereof.

13. The mounting system of claim 1, further comprising, at the front of the carriage, a protruding male centring element having a conical or rounded head, and a female receiver with conical inlet and cylindrical hollow end, for centering between the pneumatic and electrical connection modules.

14. The mounting system of claim 1, wherein the electrical module comprises a keypad which houses the electrical contacts and which comprises a central body, a rear lid, and a mobile cover; and wherein when the carriage moves in the direction of approach, the mobile cover is pushed by means that lift it towards an open position; and wherein when the carriage moves in the opposite or retraction direction, elastic means take it to the closed position thereof.

* * * * *